US005957115A

United States Patent [19]

Busato et al.

[11] Patent Number: 5,957,115

[45] Date of Patent: Sep. 28, 1999

[54] PULSE INTERVAL LEAK DETECTION SYSTEM

[75] Inventors: Murray F. Busato; John E. Cook; Paul D. Perry, all of Chatham, Canada

[73] Assignee: Siemens Canada Limited, Chatham, Canada

[21] Appl. No.: 08/798,819

[22] Filed: Feb. 12, 1997

[51] Int. Cl.[6] ..... F02M 37/04

[52] U.S. Cl. ..... 123/520; 123/198 D

[58] Field of Search ..... 123/520, 519, 123/518, 516, 521, 198 D

[56] References Cited

U.S. PATENT DOCUMENTS

| | | | |
|---|---|---|---|
| 5,069,188 | 12/1991 | Cook | 123/520 |
| 5,143,035 | 9/1992 | Kayanuma | 123/198 D |
| 5,146,902 | 9/1992 | Cook et al. | 123/518 |
| 5,193,512 | 3/1993 | Steinbrenner et al. | 123/520 |
| 5,205,263 | 4/1993 | Blumenstock et al. | 123/520 |
| 5,267,470 | 12/1993 | Cook | 73/49.7 |
| 5,299,545 | 4/1994 | Kuroda | 123/198 D |
| 5,327,873 | 7/1994 | Ohuchi | 123/198 D |
| 5,353,771 | 10/1994 | Blumenstock et al. | 123/198 D |
| 5,383,437 | 1/1995 | Cook et al. | 123/520 |
| 5,396,873 | 3/1995 | Yamanaka | 123/520 |
| 5,398,661 | 3/1995 | Denz et al. | 123/520 |
| 5,398,662 | 3/1995 | Igarashi | 123/198 D |
| 5,411,004 | 5/1995 | Busato et al. | 123/520 |
| 5,460,142 | 10/1995 | Denz et al. | 123/520 |
| 5,460,143 | 10/1995 | Narita | 123/520 |
| 5,476,083 | 12/1995 | Blumenstock | 123/520 |
| 5,505,182 | 4/1996 | Denz et al. | 123/520 |
| 5,666,925 | 9/1997 | Denz et al. | 123/520 |

*Primary Examiner*—Carl S. Miller

[57] ABSTRACT

A system and method for an engine-powered automotive vehicle evaporative emission control system having an evaporative emission space for containing volatile fuel vapors, and a leak detection system for detecting leakage from the evaporative emission space. At the beginning of a test, an initial test pressure that differs sufficiently from atmospheric pressure to allow a leak to be detected is created in the evaporative emission space. After attainment of the initial test pressure in the evaporative emission space, the initial test pressure is restored whenever the pressure changes by a predetermined amount due to a leak. The test includes measuring at least one of: a time interval required for pressure in the evaporative emission space to change from the initial test pressure by the predetermined amount; and b) a time interval required to restore the initial test pressure in the evaporative emission space.

7 Claims, 4 Drawing Sheets

PULSE INTERVAL LEAK DETECTION SYSTEM

FIELD OF THE INVENTION

This invention relates generally to an on-board system for detecting fuel vapor leakage from an evaporative emission control system of an automotive vehicle. More specifically, it relates to a novel system and method for testing the integrity of an evaporative emission control system against leakage.

BACKGROUND AND SUMMARY OF THE INVENTION

A known on-board evaporative emission control system for an automotive vehicle comprises a vapor collection canister that collects volatile fuel vapors generated in the headspace of the fuel tank by the volatilization of liquid fuel in the tank and a purge valve for periodically purging collected vapors to an intake manifold of the engine. A known type of purge valve, sometimes called a canister purge solenoid (or CPS) valve, comprises a solenoid actuator that is under the control of a microprocessor-based engine management system.

During conditions conducive to purging, evaporative emission space that is cooperatively defined by the tank headspace and the canister is purged to the engine intake manifold through a canister purge solenoid valve connected between the canister and the engine intake manifold. The canister purge solenoid valve is opened by a signal from an engine management computer in an amount that allows intake manifold vacuum to draw volatile fuel vapors from the canister for entrainment with the combustible mixture passing into the engine's combustion chamber space at a rate consistent with engine operation to provide both acceptable vehicle driveability and an acceptable level of exhaust emissions.

Certain governmental regulations require that certain automotive vehicles powered by internal combustion engines which operate on volatile fuels such as gasoline, have their evaporative emission control systems equipped with on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

It is believed fair to say that there are two basic types of diagnostic systems and methods for determining integrity of the evaporative emission space against leakage.

Commonly owned U.S. Pat. No. 5,146,902 "Positive Pressure Canister Purge System Integrity Confirmation" discloses one type: namely, a system and method for making a leakage determination by pressurizing the evaporative emission space to a certain positive pressure therein (the word "positive" meaning relative to ambient atmospheric pressure) and then watching for a drop in positive pressure indicative of a leak.

The other type makes a leakage determination by creating in the evaporative emission space a certain negative pressure (the word "negative" meaning relative to ambient atmospheric pressure so as to denote vacuum) and then watching for a loss of vacuum indicative of a leak. A known procedure employed by this latter type of system in connection with a diagnostic test comprises utilizing engine manifold vacuum to create vacuum in the evaporative emission space. Because that space may, at certain non-test times, be vented through the canister to allow vapors to be efficiently purged when the CPS valve is opened for purging of the canister, it is known to communicate the canister vent port to atmosphere through a vent valve that is open when vapors are being purged to the engine, but that closes preparatory to a diagnostic test so that a desired test vacuum can be drawn in the evaporative emission space for the test. Once a desired vacuum has been drawn, the purge valve is closed. Leakage is reflected by a loss of vacuum during the length of the test time after the purge valve has been operated closed.

In order for the engine management computer to ascertain when the desired vacuum has been drawn so that it can command the purge valve to close, and for loss of vacuum to thereafter be detected, it is known to employ an electric sensor, or transducer, that measures negative pressure, i.e. vacuum, in the evaporative emission space by supplying a measurement signal to the management computer. It is known to mount this sensor on the vehicle's fuel tank where it will be exposed to the tank headspace. For example, commonly assigned U.S. Pat. No. 5,267,470 discloses a pressure sensor mounting in conjunction with a fuel tank roll-over valve.

In one respect, the present invention is directed to a novel system and method for testing the integrity of an evaporative emission control system against leakage that is well-suited for further improving the accuracy of each of the two aforementioned basic systems and methods.

The invention provides a number of important advantages. Use of the inventive system and method in one aspect provides a time-based measurement of multiple events relating to the direct regulation of evaporative emission space test pressure, either positive or negative depending on which one of the two basic systems and methods is employed, between an upper regulating limit (URL) and a lower regulating limit (LRL). Stated another way, an aspect of the inventive system and method provides a time-based measurement of multiple events derived from an actual gas flow volume through a defined flow path substantially equal to a corresponding gas volume that has flowed through one or more leak paths in the evaporative emission space.

As a result, a system and method that embody the inventive principles is believed to be rendered more insensitive to sporadic transient events that could otherwise impair test accuracy. It is also believed to be more insensitive to other influences, such as the amount of liquid fuel in the tank when a test is being performed. By providing improved accuracy, the inventive time-based measurement of multiple events can serve to reduce the likelihood of a false indication of a leak. Moreover, the inventive system and method can serve to perform of both a "gross leak" test and a "pinched-line" test, as well as a measurement of the size of a leak.

Speaking generally of its apparatus aspect, the invention relates to an engine-powered automotive vehicle evaporative emission control system comprising an evaporative emission space for containing volatile fuel vapors, and a leak detection system for detecting leakage from the evaporative emission space, wherein leak detection system comprises: initial pressurizing means operable at the beginning of a test for creating in the evaporative emission space, an initial test pressure that differs sufficiently from atmospheric pressure to allow a leak to be detected; pressure restoring means operable after attainment of the initial test pressure in the evaporative emission space for restoring the initial test pressure in the evaporative emission space whenever the pressure changes by a predetermined amount due to a leak; and measuring means for measuring at least one of: a) a time interval required for pressure in the evaporative emission space to change from the initial test pressure by the predetermined amount; and b) a time interval required for the pressure restoring means to restore the initial test pressure in the evaporative emission space.

Speaking generally of its method aspect, the invention relates to performing a leak detection which comprises: at the beginning of a test, creating in the evaporative emission space, an initial test pressure that differs sufficiently from atmospheric pressure to allow a leak to be detected; after attainment of the initial test pressure in the evaporative emission space, restoring the initial test pressure in the evaporative emission space whenever the pressure changes from the initial test pressure by a predetermined amount due to a leak; and measuring at least one of: a) a time interval required for pressure in the evaporative emission space to change from the initial test pressure by the predetermined amount; and b) a time interval required to restore the initial test pressure in the evaporative emission space. The foregoing, along with further details, features, advantages, and benefits of the invention, will be seen in the ensuing description and claims, which are accompanied by drawings. The drawings disclose a presently preferred embodiment of the invention according to the best mode contemplated at this time for carrying out the invention.

DESCRIPTION OF THE PREFERRED EMBODIMENT

Figure 1:
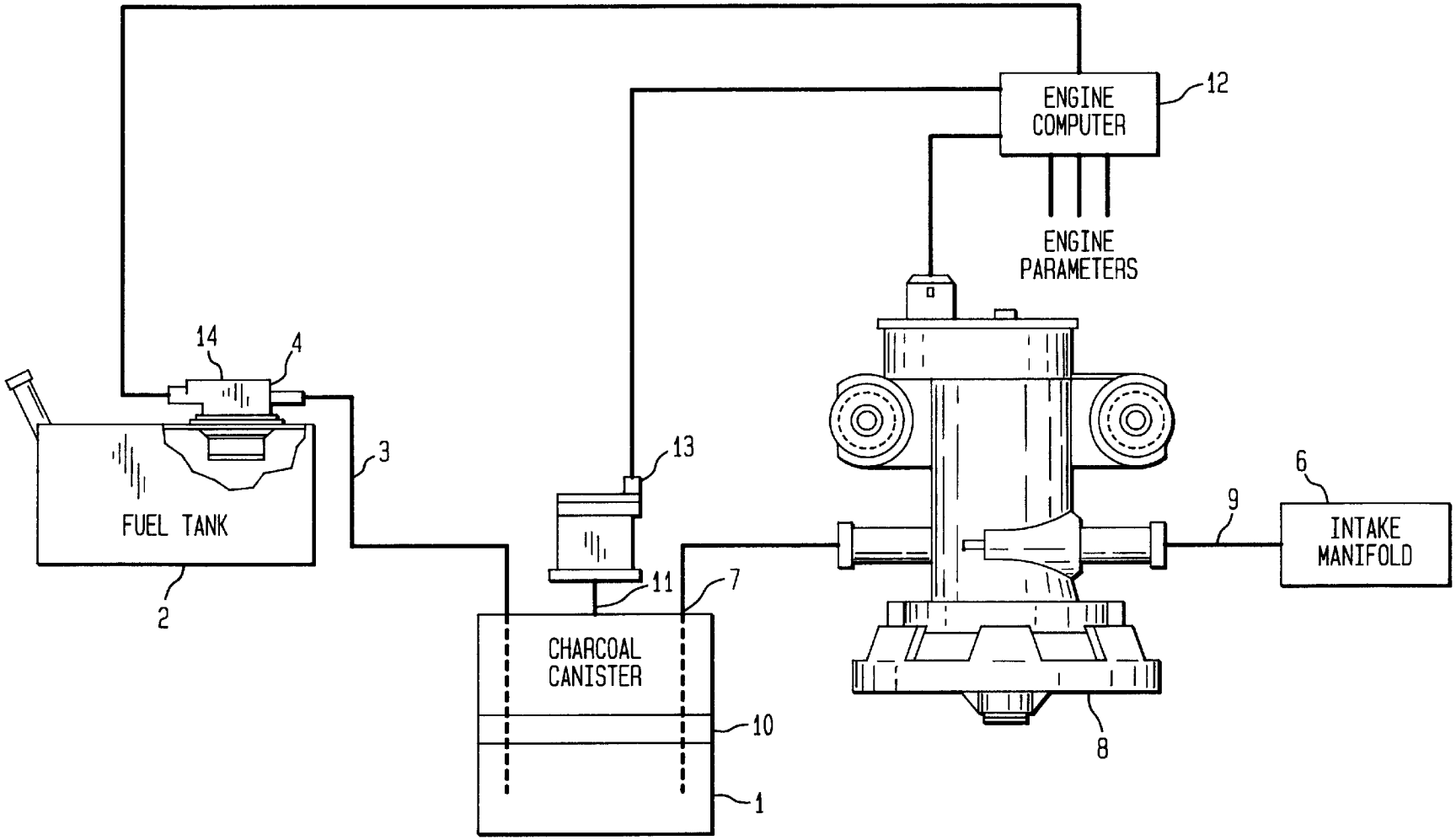
FIG. 1 is a schematic diagram of an evaporative emission control system embodying principles of the invention.

FIG. 1 shows an evaporative emission control system of a motor vehicle comprising a vapor collection canister 1 and a canister purge solenoid valve 8 connected in series between a fuel tank 2 and an intake manifold 6 of an internal combustion engine in a known fashion. An engine management computer 12 supplies a purge valve control signal for operating valve 8.

Valve 8 comprises an inlet port that is fluid-coupled via a conduit with a purge port 7 of canister 1 and an outlet port that is fluid-coupled via a conduit 9 with intake manifold 6. A conduit 3 communicates a canister tank port to headspace of fuel tank 2 through a tank-mounted roll-over valve 4 that also includes a pressure sensor 14 for sensing pressure in the evaporative emission space. It is to be understood however that the general principles of the invention contemplate that any suitable means of providing a signal representing pressure (either positive or negative depending on type of system) in the evaporative emission space may be employed. Such a sensor may be located in any of a number of different locations and it may be electronic or electromechanical.

The canister contains a medium 10, such as charcoal, that can absorb fuel vapors. The canister also has an atmospheric vent port 11, and it is constructed such that fuel vapor is absorbed by the charcoal before it can reach the vent port and such that vapors can pass directly from the tank headspace to the purge valve.

The purge valve has an operating mechanism comprising a solenoid actuator for opening and closing an internal passage that extends between its inlet and outlet ports. The mechanism includes a bias spring that acts to urge a valve element closed against a valve seat for closing the internal passage to flow. When the solenoid actuator is progressively energized by electric current controlled by engine management computer 12, an internal armature opposes the bias spring force to unseat the valve element from the valve seat and thus open the internal passage so that flow can occur through the purge valve.

A vent valve 13 is connected to canister vent port 11. Vent valve 13 comprises a solenoid-operated mechanism that is under the control of computer 12. It also comprises a first port that is fluid-connected with canister vent port and a second port that is communicated to atmosphere, preferably through a particulate filter (not shown), which is disposed either internal or external to the valve housing.

When no leak detection test is being performed, the canister purge valve is operated by computer 12 to periodically purge vapors from the canister and the tank headspace to the engine. The exact scheduling of such purging is controlled by the vehicle manufacturer's requirements. The vent valve typically remains open so that the vent port of the canister is communicated to atmosphere. When a leak detection test is to be conducted on the evaporative emission control system, vent valve 13 is operated closed by computer 12, and purge valve 8 is opened by the computer to begin drawing a vacuum in the evaporative emission space comprising the tank, the canister, and any spaces, such as associated conduits, that are in communication therewith. Naturally all closures, such as the vehicle tank filler cap, must be in place to close the space under test.

If there are no conditions, such as a "pinched line" for example, that prevent the desired predefined vacuum from being drawn in the evaporative emission space within limits of a predefined initial pressurization time (i.e. a draw-down time in the case of vacuum being drawn) counted by the computer, the pressure sensor will eventually detect that the predefined vacuum, such as ten inches of water for example, has been drawn, with the computer then causing the purge valve to close. This predefined vacuum had been programmed into computer 12 and constitutes what will be herein referred to as an upper regulating limit, or URL. If the evaporative emission space is completely fluid-tight, meaning no leaks, the vacuum will be maintained without loss during the length of the leak detection test time. The leak detection test time commences after the initial pressurization time when the computer signals the purge valve to close.

Had the desired vacuum not been drawn within the programmed window that defines the draw-down time, a "pinched line" or "gross leak" would be indicated and the ensuing leak detection test aborted. Generally speaking, a gross leak will be indicated by the inability to draw down the vacuum within the maximum time allowed by the programmed window, and a "pinched line", by drawing the desired vacuum in a time less than the minimum time allowed by the programmed window. It is to be appreciated however that in any given configuration, the locations of the lines and of a pressure sensor that may be used to measure evaporative emission space pressure can affect these generalizations.

On the other hand, if there is some leakage from the defined evaporative emission space once the leak detection test time has commenced, pressure sensor 14 will detect a loss of vacuum caused by flow through the leak. A second predefined vacuum has been stored in computer 12 and constitutes what will be herein referred to as a lower regulating limit, or LRL. By example, a suitable LRL may be nine inches water for a URL of ten inches water. If these limits are fixed, the pressure sensor can be an electromechanical pressure switch with appropriate switching action for these limits.

Figure 3:
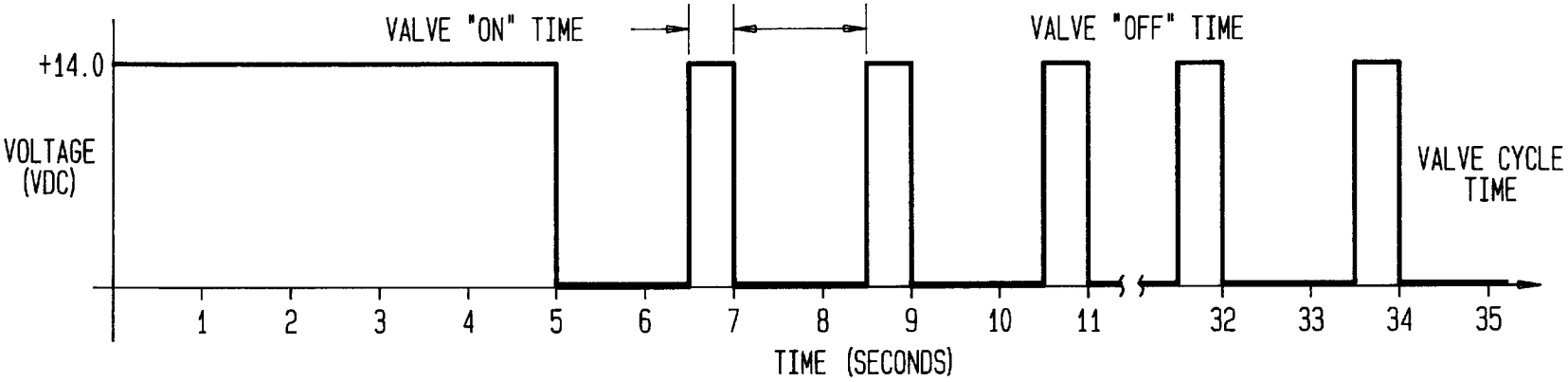
FIGS. 3, 4, and 5 are respective graph plots useful in understanding the inventive principles.
Figure 4:
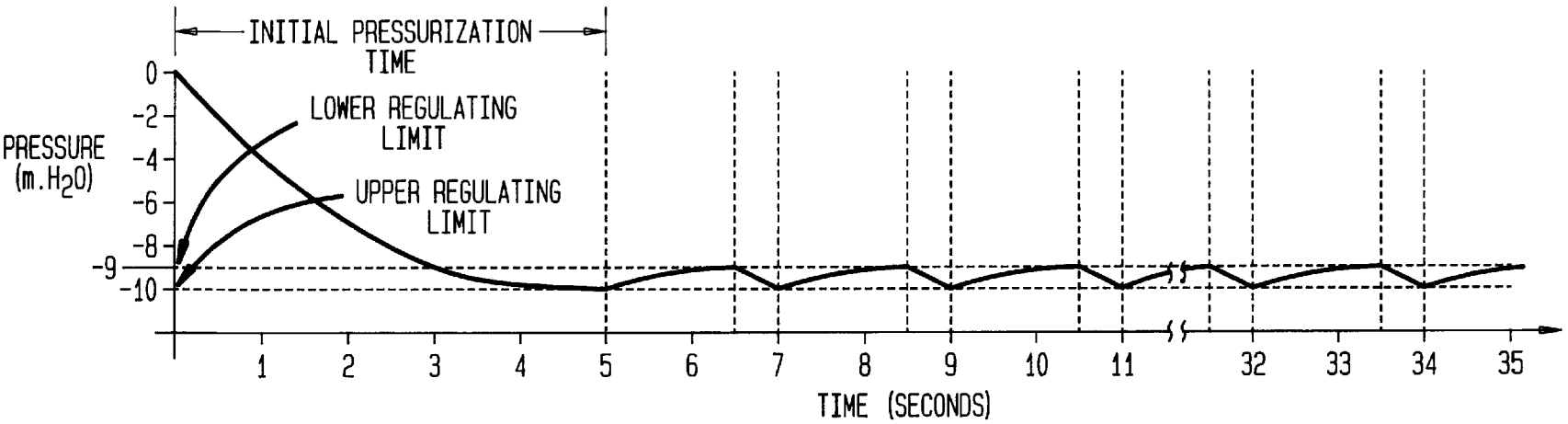

FIG. 4 shows an exemplary graph plot of vacuum vs. time commencing at zero seconds and with the evaporative emission space pressure being at zero inches water relative to atmosphere. FIG. 3 shows the corresponding operating condition of the purge valve. When the pressure sensor senses that the URL has been reached, (five seconds in the example of FIGS. 3 and 4), the purge valve is operated closed. If a leak is present, vacuum begins to be lost. When the vacuum sensed by the pressure sensor reaches the LRL, the computer commands the purge valve to open. This causes vacuum to increase. When the URL is reached, the purge valve is again operated closed.

Figure 5:
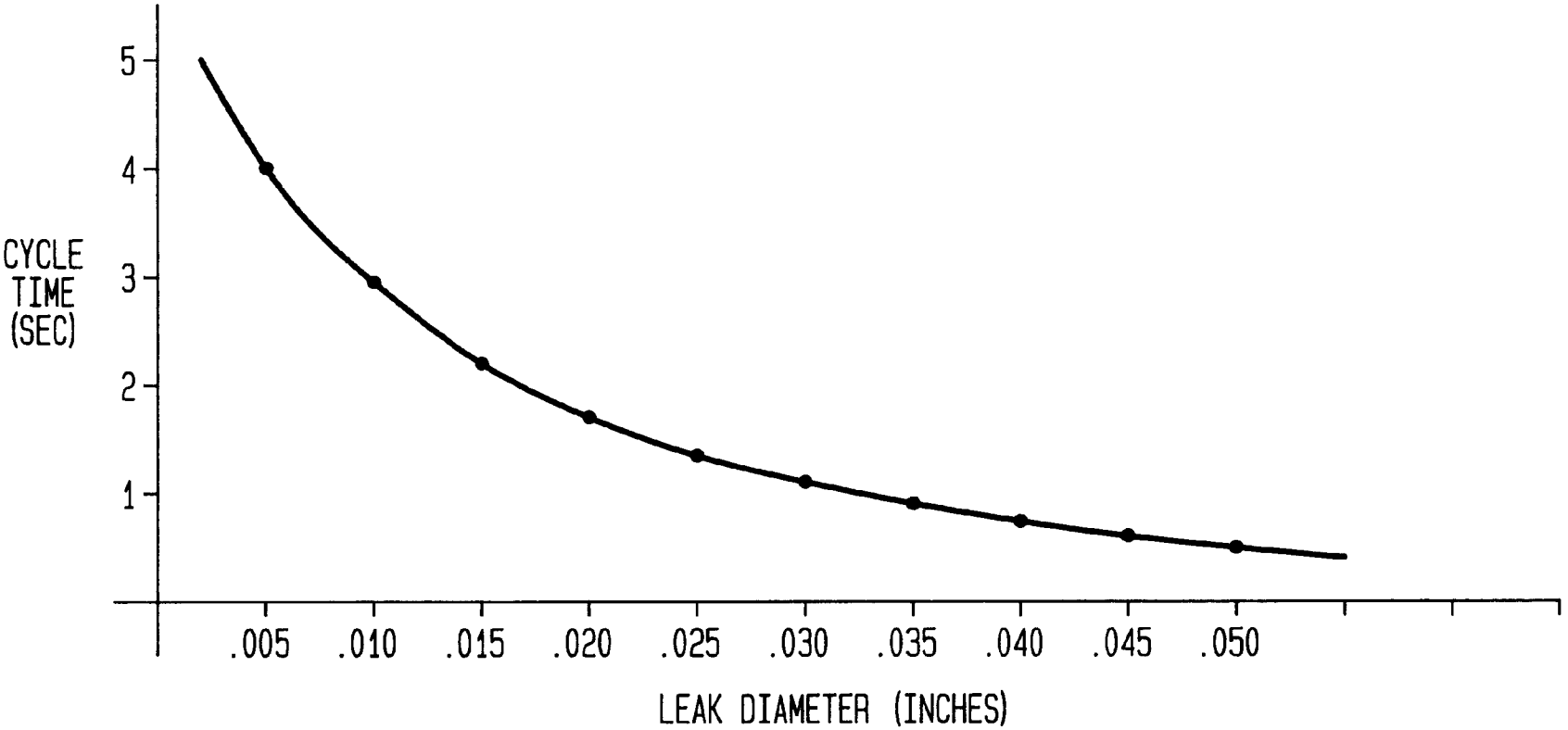

As a result, it is to be understood that the purge valve will cycle in a manner like that depicted by FIG. 3. The cycle time corresponds to the size of the leak path or paths, as shown by FIG. 5 which correlates cycle time to leakage measured as the diameter of a circle whose area corresponds to the size of the total area of all leak paths. It can be appreciated that smaller leaks will result in longer closed intervals between open intervals of the purge valve, and larger leaks, shorter closed intervals.

Computer 12 monitors the duration of each successive interval, i.e. closed, open, closed, open, . . . etc. These data measurements are processed by the computer in accordance with algorithms programmed into it. During any given test when spurious transient conditions do not occur, the open intervals should be fairly consistent, as should the closed intervals. As will be explained later, one or both types of intervals may be used by computer 12 to determine the effective leak size by an appropriate algorithm, preferably including one or more correction factors. A disturbance that creates a momentary spurious condition that might otherwise affect a test can in effect be ignored by the computer algorithms. For example, if, over a number of cycle times during a leak detection test, the closed intervals are substantially identical except for perhaps one, that one may be deemed a disturbance that is ignored.

The inventive system and method can conveniently employ various correction factors, as required, to take into account variables, such as liquid fuel volume in the tank, fuel vapor pressure in the evaporative emission space, engine manifold vacuum, and altitude.

Because the amount of liquid fuel in the fuel tank influences the volume of the evaporative emission space, a tank with less liquid fuel will take longer to pressurize than one with more liquid fuel. The inventive system and method can take this into account by including a correction measurement, such as ratioing the length of an open time interval to that of an immediately succeeding closed time interval to establish a correction factor. Thus, it is most advantageous to measure both: a) a time interval required for pressure in the evaporative emission space to change from the initial test pressure by the predetermined amount; and b) a time interval required to restore the initial test pressure in the evaporative emission space, although in one of their more general aspects, the inventive principles contemplate the need to measure only one of these intervals. Various correction algorithms may be employed for various emission system configurations.

The correction for liquid fuel volume, such as by the ratioing just mentioned, effectively normalizes the graph plot of any test to substantially eliminate liquid fuel volume as a test variable that could otherwise impair accuracy. Such correction may be done at any suitable time or times, at the beginning of, during, and/or the end of a test.

Effectiveness of the inventive system and method is predicated on reasonable stability of the pressurizing source, be it vacuum in the case of negative pressurization, or positive pressure when a pressurizing pump is used. For example in the case of using the intake manifold to draw vacuum, significant variations in vacuum may affect a test unless they are taken into account. One way to do this is to utilize a signal from an engine MAP sensor as an input to the computer which utilizes that signal in a correction algorithm. Another way is to utilize a pressure regulator, which may be either internal or external to the purge valve. An example of a pressure regulated purge valve appears in commonly assigned U.S. Pat. No. 5,069,188. Still another way is to employ a sonic nozzle that will maintain constant flow through a canister purge valve for a given signal input to the valve.

Variation in tank fuel vapor pressure may affect test results by influencing the rate of change between the URL and LRL. Such variation may be corrected by closing the canister vent valve 13 for a certain amount of time prior to beginning of pressurization, and monitoring pressure. From this, the rate of change in fuel vapor pressure in the headspace is calculated, and a correction made by a correction algorithm.

Altitude variations can be corrected in vehicles that have MAP sensors because such sensors have the capability of approximating altitude. Correction is made by a suitable algorithm.

A further advantage of the inventive system and method is that the cycling of the canister purge valve during a leak detection test time inherently verifies flow through the evaporative emission system.

A still further advantage is that the open time intervals may be used to measure leakage as an alternative to measuring the closed time intervals.

Figure 2:
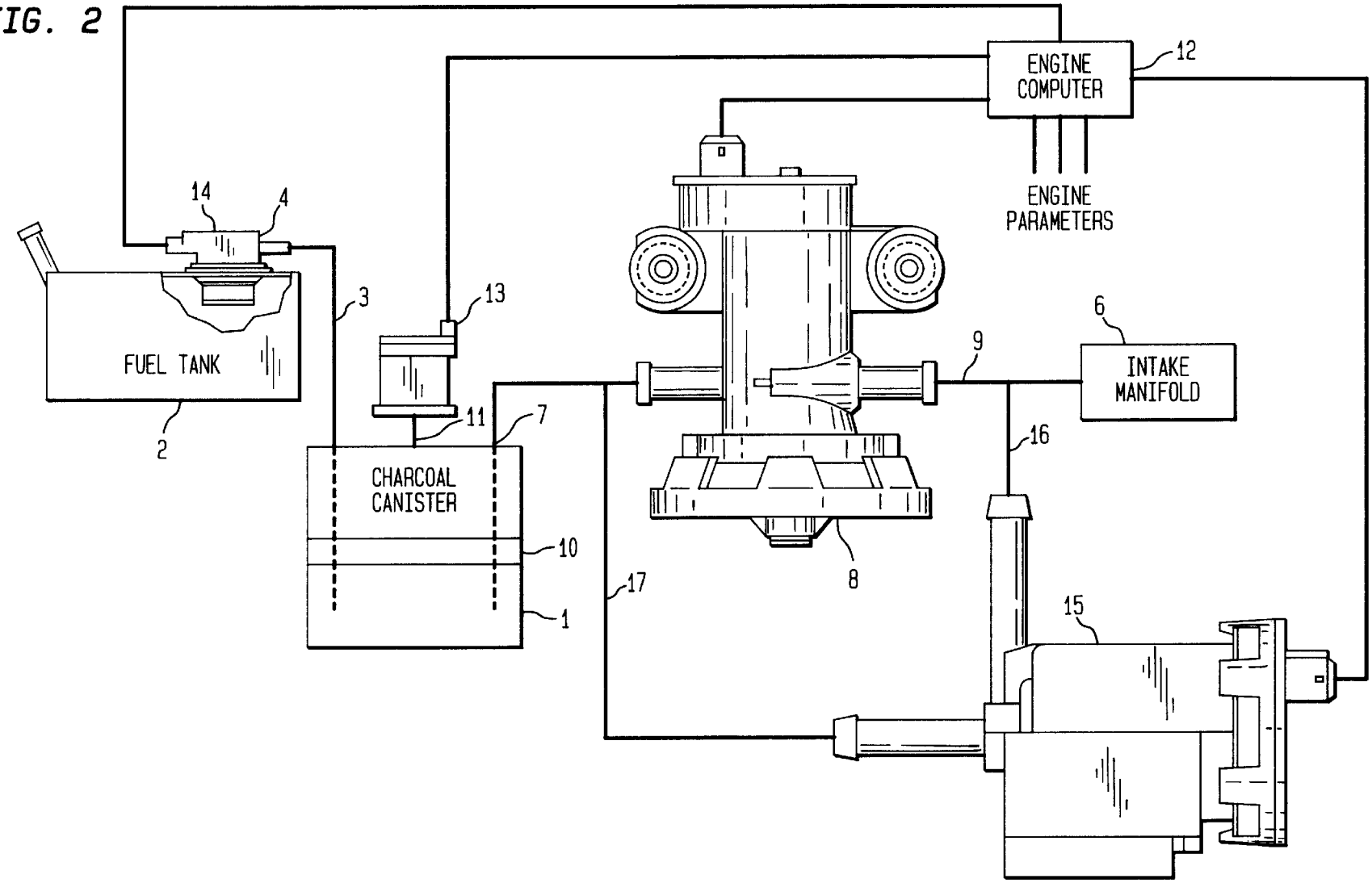
FIG. 2 is a schematic diagram of another evaporative emission control system embodying principles of the invention.

FIG. 2 shows an embodiment in which a separate valve 15 is connected pneumatically in parallel with the canister purge valve. This separate valve is devoted to use either exclusively, or in combination with the canister purge valve, for performing the leak detection test.

While a presently preferred embodiment of the invention has been illustrated and described, it is to be appreciated that the principles may be practiced in other equivalent ways within the scope of the following claims. For example, while the specific example presented herein shows vacuum being drawn through a control valve from the intake manifold, vacuum, or positive pressure in the case of positively pressurizing the evaporative emission space, can be introduced at any suitable location, through any suitable control valve, and from any suitable source of vacuum or pressure.

What is claimed is:

1. In an engine-powered automotive vehicle evaporative emission control system comprising an evaporative emission space for containing volatile fuel vapors, and a leak detection system for detecting leakage from the evaporative emission space, the improvement in said leak detection system which comprises:

initial pressurizing means operable at the beginning of a test for creating in the evaporative emission space, an initial test pressure that differs sufficiently from atmospheric pressure to allow a leak to be detected;

pressure restoring means operable after attainment of the initial test pressure in the evaporative emission space for restoring the initial test pressure in the evaporative emission space whenever the pressure changes from the initial test pressure by a predetermined amount, thereby indicating a leak; and measuring means for measuring leakage after the indication thereof, the measuring means comprising: 1) time interval measuring means for measuring at least one of a) a time interval required for pressure in the evaporative emission space to change from the initial test pressure by the predetermined amount, and b) a time interval required for the pressure restoring means to restore the initial test pressure in the evaporative emission space, whereby at least one time interval measurement is obtained; and 2) processing means for processing the obtained at least one time interval measurement to obtain a measurement of leakage.

2. The improvement set forth in claim 1 including correction means for utilizing both measured time intervals to establish a correction factor for liquid fuel volume in the tank.

3. The improvement set forth in claim 2 in which the correction means ratios the measured time intervals to establish a correction factor for liquid fuel volume in the tank.

4. The improvement set forth in claim 1 including a pressure sensing means for sensing pressure in the evaporative emission space during a test.

5. The improvement set forth in claim 1 including a fuel tank for storing volatile fuel that is combusted in combustion chamber space of the engine and a fuel vapor collection canister define at least a portion of the evaporative emission space, and a purge valve is periodically operated to purge vapors from the evaporative emission space.

6. The improvement set forth in claim 5 in which the purge valve forms a portion of both the initial pressurizing means and the pressure restoring means.

7. In an engine-powered automotive vehicle evaporative emission control system comprising an evaporative emission space for containing volatile fuel vapors, and a leak detection system for detecting leakage from the evaporative emission space, the improvement in performing leak detection which comprises:

at the beginning of a test, creating in the evaporative emission space, an initial test pressure that differs sufficiently from atmospheric pressure to allow a leak to be detected;

after attainment of the initial test pressure in the evaporative emission space, restoring the initial test pressure in the evaporative emission space whenever the pressure changes from the initial test pressure by a predetermined amount, thereby indicating a leak; and measuring leakage after the indication thereof by: obtaining at least one time interval measurement by measuring at least one of a) a time interval required for pressure in the evaporative emission space to change from the initial test pressure by the predetermined amount, and b) a time interval required to restore the initial test pressure in the evaporative emission space; and 2) processing the obtained at least one time interval measurement to obtain a measurement of leakage.

* * * * *